US009650971B2

(12) United States Patent
Pirjaberi et al.

(10) Patent No.: US 9,650,971 B2
(45) Date of Patent: May 16, 2017

(54) FIRING FRACTION MANAGEMENT IN SKIP FIRE ENGINE CONTROL

(71) Applicant: Tula Technology, Inc., San Jose, CA (US)

(72) Inventors: Mohammad R. Pirjaberi, San Jose, CA (US); Steven E. Carlson, Oakland, CA (US); Louis J. Serrano, Los Gatos, CA (US); Xin Yuan, Palo Alto, CA (US); Li-Chun Chien, Milpitas, CA (US); Adya S. Tripathi, San Jose, CA (US)

(73) Assignee: Tula Technology, Inc., San Jose, CA (US)

( * ) Notice: Subject to any disclaimer, the term of this patent is extended or adjusted under 35 U.S.C. 154(b) by 526 days.

(21) Appl. No.: 13/963,686

(22) Filed: Aug. 9, 2013

(65) Prior Publication Data

US 2014/0041625 A1 Feb. 13, 2014
US 2016/0363062 A9 Dec. 15, 2016

Related U.S. Application Data

(63) Continuation of application No. PCT/US2013/054027, filed on Aug. 7, 2013, and a
(Continued)

(51) Int. Cl.
*F02D 17/02* (2006.01)
*F02D 41/00* (2006.01)
(Continued)

(52) U.S. Cl.
CPC ..... *F02D 41/00* (2013.01); *F02D 11/105* (2013.01); *F02D 17/02* (2013.01);
(Continued)

(58) Field of Classification Search
CPC ..... F02D 41/0087; F02D 17/02
(Continued)

(56) References Cited

U.S. PATENT DOCUMENTS 2,771,867 A 11/1956 Peras
2,875,742 A 3/1959 Dolza
(Continued)

FOREIGN PATENT DOCUMENTS

CN 101628580 1/2010

OTHER PUBLICATIONS

International Search Report dated Dec. 13, 2013 from International Application No. PCT/US2013/54027.
(Continued)

*Primary Examiner* — Erick Solis
(74) *Attorney, Agent, or Firm* — Beyer Law Group LLP

(57) ABSTRACT

The described embodiments relate generally to skip fire control of internal combustion engines and particularly to mechanisms for determining a desired operational firing fraction. In some embodiments, a firing fraction determining unit is arranged to determine a firing fraction suitable for delivering a requested engine output. The firing fraction determining unit may utilize data structures such as lookup tables in the determination of the desired firing fraction. In one aspect the desired engine output and one or more operational power train parameters such as current engine speed, are used as indices to a lookup table used to select a desired firing fraction. In other embodiments, additional indices to the data structure may include any one of: transmission gear; manifold absolute pressure (MAP); manifold air temperature; a parameter indicative of mass air charge (MAC); cam position; cylinder torque output; maximum permissible manifold pressure; vehicle speed; and barometric pressure.

26 Claims, 8 Drawing Sheets

Related U.S. Application Data continuation-in-part of application No. 13/004,844, filed on Jan. 11, 2011, now Pat. No. 8,701,628.

(60) Provisional application No. 61/682,065, filed on Aug. 10, 2012, provisional application No. 61/294,077, filed on Jan. 11, 2010.

(51) Int. Cl.
*F02D 41/02* (2006.01)
*F02D 11/10* (2006.01)
*F02D 41/24* (2006.01)

(52) U.S. Cl.
CPC ..... *F02D 41/0087* (2013.01); *F02D 41/0225* (2013.01); *F02D 41/2422* (2013.01); *F02D 2250/18* (2013.01)

(58) Field of Classification Search
USPC ..... 123/198 F, 198 DC, 481
See application file for complete search history.

(56) References Cited

U.S. PATENT DOCUMENTS 4,064,844 A 12/1977 Matsumoto et al.
4,172,434 A 10/1979 Coles
4,434,767 A 3/1984 Kohama et al.
4,489,695 A 12/1984 Kohama et al.
4,509,488 A 4/1985 Forster et al.
4,541,387 A 9/1985 Morikawa
5,117,790 A 6/1992 Clarke et al.
5,377,631 A 1/1995 Schechter
5,540,633 A 7/1996 Yamanaka et al.
5,553,575 A * 9/1996 Beck ..... F02B 37/16 123/198 F
5,584,266 A 12/1996 Motose et al.
5,692,471 A 12/1997 Zhang
5,720,257 A 2/1998 Motose et al.
5,778,858 A 7/1998 Garabedian
5,826,563 A 10/1998 Patel et al.
5,975,052 A 11/1999 Moyer
6,158,411 A 12/2000 Morikawa
6,360,724 B1 * 3/2002 Suhre ..... F02D 17/02 123/198 F
6,408,625 B1 6/2002 Woon et al.
6,415,601 B1 7/2002 Glugla et al.
6,615,804 B2 9/2003 Matthews et al.
6,619,258 B2 9/2003 McKay et al.
6,655,353 B1 12/2003 Rayl
6,978,204 B2 12/2005 Surnilla et al.
7,028,670 B2 4/2006 Doering
7,032,545 B2 4/2006 Lewis et al.
7,032,581 B2 4/2006 Gibson et al.
7,044,101 B1 5/2006 Duty et al.
7,063,062 B2 6/2006 Lewis et al.
7,066,136 B2 6/2006 Ogiso
7,086,386 B2 8/2006 Doering
7,278,391 B1 10/2007 Wong et al.
7,426,915 B2 9/2008 Gibson et al.
7,503,312 B2 3/2009 Surnilla et al.
7,532,972 B2 5/2009 Kolmanovsky et al.
7,571,707 B2 8/2009 Gibson et al.
7,836,866 B2 11/2010 Luken et al.
7,930,087 B2 4/2011 Gibson et al.
7,941,994 B2 5/2011 Surnilla et al.
8,099,224 B2 1/2012 Tripathi et al.
8,108,132 B2 1/2012 Reinke
8,473,179 B2 6/2013 Whitney et al.
9,020,735 B2 4/2015 Tripathi et al.
9,200,587 B2 12/2015 Serrano et al.
2002/0096134 A1 7/2002 Michelini et al.
2003/0105577 A1 6/2003 Bortolin
2006/0130814 A1 6/2006 Bolander et al.
2008/0154468 A1 6/2008 Berger et al.
2009/0177371 A1 7/2009 Reinke
2010/0012053 A1 * 1/2010 Surnilla ..... B60W 10/06 123/21
2010/0043744 A1 2/2010 Suzuki et al.
2010/0050993 A1 3/2010 Zhao et al.
2011/0208405 A1 * 8/2011 Tripathi ..... F02D 17/02 701/102
2011/0213540 A1 * 9/2011 Tripathi ..... F02D 37/02 701/102
2011/0213541 A1 9/2011 Tripathi et al.
2013/0092127 A1 4/2013 Pirjaberi et al.
2013/0092128 A1 4/2013 Pirjaberi et al.
2014/0053802 A1 2/2014 Rayl
2014/0053804 A1 2/2014 Rayl et al.
2014/0053805 A1 2/2014 Brennan et al.
2014/0069178 A1 3/2014 Beikmann
2014/0069378 A1 3/2014 Burleigh et al.
2014/0069379 A1 3/2014 Beikmann
2014/0069381 A1 3/2014 Beikmann
2014/0090623 A1 4/2014 Beikmann
2014/0090624 A1 4/2014 Verner
2014/0102411 A1 4/2014 Brennan

OTHER PUBLICATIONS

Written Opinion dated Dec. 13, 2013 from International Application No. PCT/US2013/54027.
Chinese Office Action dated Jul. 19, 2016 from corresponding Chinese Application No. 201380041485.2.
Chinese Office Action dated Mar. 10, 2017 from Chinese Application No. 201380041485.2.

* cited by examiner

200

211

209

GEAR 1 Torque 1000

GEAR 2 Torque

GEAR 3 Torque 1000

GEAR 4 Torque 1000

GEAR 5 Torque

GEAR 6

| Torque request | 1000 RPM | 1250 RPM | 1500 RPM | 1750 RPM | 2000 RPM | 2250 RPM | 2500 RPM | 2750 RPM | 3000 RPM | 3250 RPM | 3350 RPM |
|---|---|---|---|---|---|---|---|---|---|---|---|
| 0 | 0.325 | 0.244 | 0.195 | 0.162 | 0.162 | 0.139 | 0.139 | 0.108 | 0.108 | 0.108 | 0.108 |
| 0.05 | 0.325 | 0.244 | 0.195 | 0.162 | 0.162 | 0.139 | 0.139 | 0.108 | 0.108 | 0.108 | 0.108 |
| 0.1 | 0.325 | 0.244 | 0.195 | 0.162 | 0.162 | 0.139 | 0.139 | 0.124 | 0.118 | 0.108 | 0.108 |
| 0.15 | 0.325 | 0.244 | 0.204 | 0.205 | 0.204 | 0.233 | 0.231 | 0.219 | 0.213 | 0.183 | 0.171 |
| 0.2 | 0.333 | 0.341 | 0.317 | 0.315 | 0.315 | 0.311 | 0.299 | 0.282 | 0.267 | 0.260 | 0.263 |
| 0.25 | 0.404 | 0.433 | 0.401 | 0.408 | 0.423 | 0.414 | 0.393 | 0.364 | 0.338 | 0.337 | 0.329 |
| 0.3 | 0.558 | 0.545 | 0.484 | 0.501 | 0.554 | 0.546 | 0.522 | 0.477 | 0.425 | 0.390 | 0.389 |
| 0.35 | 0.740 | 0.669 | 0.574 | 0.612 | 0.646 | 0.638 | 0.611 | 0.543 | 0.479 | 0.453 | 0.433 |
| 0.4 | 0.919 | 0.774 | 0.687 | 0.722 | 0.739 | 0.734 | 0.664 | 0.582 | 0.540 | 0.479 | 0.468 |
| 0.45 | 1 | 0.872 | 0.835 | 0.825 | 0.831 | 0.823 | 0.754 | 0.643 | 0.596 | 0.535 | 0.533 |
| 0.5 | 1 | 0.961 | 0.942 | 0.921 | 0.923 | 0.915 | 0.837 | 0.714 | 0.623 | 0.594 | 0.589 |
| 0.55 | 1 | 1 | 1 | 1 | 1 | 1 | 0.919 | 0.786 | 0.674 | 0.654 | 0.644 |
| 0.6 | 1 | 1 | 1 | 1 | 1 | 1 | 0.982 | 0.853 | 0.734 | 0.711 | 0.704 |
| 0.65 | 1 | 1 | 1 | 1 | 1 | 1 | 0.999 | 0.911 | 0.796 | 0.769 | 0.760 |
| 0.7 | 1 | 1 | 1 | 1 | 1 | 1 | 1 | 0.931 | 0.856 | 0.835 | 0.829 |
| 0.75 | 1 | 1 | 1 | 1 | 1 | 1 | 1 | 0.951 | 0.914 | 0.854 | 0.812 |
| 0.8 | 1 | 1 | 1 | 1 | 1 | 1 | 1 | 1 | 0.975 | 0.865 | 0.865 |
| 0.85 | 1 | 1 | 1 | 1 | 1 | 1 | 1 | 1 | 0.981 | 0.940 | 0.922 |
| 0.9 | 1 | 1 | 1 | 1 | 1 | 1 | 1 | 1 | 1 | 0.982 | 0.971 |
| 0.95 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 |

| 1000 RPM | 1250 RPM | 1500 RPM | 1750 RPM | 2000 RPM | 2250 RPM | 2500 RPM | 2750 RPM | 3000 RPM | 3250 RPM | 3350 RPM |
|---|---|---|---|---|---|---|---|---|---|---|
| 0 | 1 | 1 | 0.478 | 0.454 | 0.466 | 0.466 | 0.466 | 0.466 | 0.466 | 0.466 |
| 0.05 | 1 | 1 | 0.442 | 0.454 | 0.466 | 0.466 | 0.466 | 0.466 | 0.466 | 0.466 |
| | | | | | | | | | 466 | 0.466 | 0.466 |
| | | | | | | | | | 466 | 0.466 | 0.466 |
| | | | | | | | | | 466 | 0.466 | 0.466 |
| | | | | | | | | | 466 | 0.466 | 0.466 |
| | | | | | | | | | 466 | 0.466 | 0.466 |
| | | | | | | | | | 488 | 0.488 | 0.488 |
| | | | | | | | | | 540 | 0.500 | 0.500 |
| | | | | | | | | | 596 | 0.535 | 0.533 |
| | | | | | | | | | 623 | 0.594 | 0.589 |
| | | | | | | | | | 674 | 0.654 | 0.644 |
| | | | | | | | | | 734 | 0.711 | 0.704 |
| | | | | | | | | | 796 | 0.769 | 0.760 |
| | | | | | | | | | 856 | 0.835 | 0.829 |
| | | | | | | | | | 914 | 0.854 | 0.812 |
| | | | | | | | | | 975 | 0.865 | 0.865 |
| | | | | | | | | | 981 | 0.940 | 0.922 |
| | | | | | | | | | 1 | 0.982 | 0.971 |
| | | | | | | | | | 1 | 1 | 1 |
| | | | | | | | | | 1 | 1 | 1 |

| 3350 RPM |
|---|
| 0.108 |
| 0.108 |
| 0.108 |
| 0.175 |
| 0.263 |
| 0.329 |
| 0.389 |
| 0.433 |
| 0.468 |
| 0.533 |
| 0.589 |
| 0.644 |
| 0.704 |
| 0.760 |
| 0.829 |
| 0.812 |
| 0.865 |
| 0.922 |
| 0.971 |
| 1 |
| 1 |

210, nonstandard entry

207

203, 204

205

*FIG. 2*

| Gear 6 | | 1500 RPM | | |
|---|---|---|---|---|
| Torque request | .... | FF | MAC Adjust | |
| ⋮ | | ⋮ | ⋮ | |
| 0.150 | .... | 0.222 | 0.944 | .... |
| 0.153 | | 0.222 | 0.968 | |
| 0.155 | .... | 0.222 | 0.992 | .... |
| 0.158 | | 0.222 | 1.016 | |
| 0.160 | | 0.222 | 1.041 | |
| 0.163 | .... | 0.250 | 0.945 | .... |
| 0.165 | | 0.250 | 0.967 | |
| 0.168 | .... | 0.250 | 0.988 | .... |
| 0.170 | | 0.250 | 1.010 | |
| 0.173 | .... | 0.250 | 1.031 | .... |
| 0.175 | | 0.273 | 0.964 | |
| 0.178 | .... | 0.273 | 0.983 | .... |
| 0.180 | | 0.273 | 1.003 | |
| 0.183 | | 0.273 | 1.023 | |
| 0.185 | .... | 0.286 | 0.995 | .... |
| 0.188 | | 0.286 | 1.013 | |
| 0.190 | | 0.300 | 0.984 | |
| 0.193 | .... | 0.300 | 1.002 | .... |
| 0.195 | | 0.300 | 1.020 | |
| 0.198 | | 0.333 | 0.935 | |
| 0.200 | | 0.333 | 0.952 | |
| ⋮ | | ⋮ | ⋮ | |

FIG. 4

| Gear | 1000 RPM | 1250 RPM | 1500 RPM | 1750 RPM | 2000 RPM | 2250 RPM | 2500 RPM | 2750 RPM | 3000 RPM | 3250 RPM | 3350 RPM |
|---|---|---|---|---|---|---|---|---|---|---|---|
| 1 | 1 | 1 | 1 | 0.158 | 0.158 | 0.136 | 0.136 | 0.136 | 0.136 | 0.136 | 0.136 |
| 2 | 1 | 1 | 0.442 | 0.454 | 0.466 | 0.466 | 0.466 | 0.466 | 0.466 | 0.466 | 0.466 |
| 3 | 0.288 | 0.288 | 0.288 | 0.288 | 0.288 | 0.288 | 0.288 | 0.288 | 0.288 | 0.288 | 0.312 |
| 4 | 0.322 | 0.241 | 0.193 | 0.161 | 0.161 | 0.138 | 0.138 | 0.138 | 0.138 | 0.138 | 0.138 |
| 5 | 0.323 | 0.243 | 0.194 | 0.162 | 0.162 | 0.139 | 0.139 | 0.108 | 0.108 | 0.108 | 0.108 |
| 6 | 0.325 | 0.244 | 0.195 | 0.162 | 0.162 | 0.139 | 0.139 | 0.108 | 0.108 | 0.108 | 0.108 |

*FIG. 6*

FIRING FRACTION MANAGEMENT IN SKIP FIRE ENGINE CONTROL

CROSS REFERENCE TO RELATED APPLICATIONS

This application is a Continuation-in-Part of U.S. application Ser. No. 13/004,844, filed on Jan. 11, 2011, now U.S. Pat. No. 8,701,628. U.S. application Ser. No. 13/004,844 claims priority to U.S. Provisional Application No. 61/294,077, filed on Jan. 11, 2010. This application is also a Continuation of International Application No. PCT/US13/054027, filed Aug. 7, 2013 and claims priority to U.S. Provisional Application No. 61/682,065, filed Aug. 10, 2012, each of which is hereby incorporated by reference.

FIELD OF THE INVENTION

The present invention relates generally to skip fire control of internal combustion engines and particularly to mechanisms for determining a desired operational firing fraction. In some embodiments data structures such as lookup tables are used to determine the desired firing fraction.

BACKGROUND

Most vehicles in operation today (and many other devices) are powered by internal combustion (IC) engines. Internal combustion engines typically have a plurality of cylinders or other working chambers where combustion occurs. Under normal driving conditions, the torque generated by an internal combustion engine needs to vary over a wide range in order to meet the operational demands of the driver. Over the years, a number of methods of controlling internal combustion engine torque have been proposed and utilized. In most gasoline engines, the output of the engine are primarily modulated by controlling the amount of air (and corresponding amount of fuel) delivered to the working chambers. In many diesel engines, the output is modulated primarily by controlling the amount of fuel delivered to the working chambers.

Some approaches seek to improve the thermodynamic efficiency of the engine by varying the effective displacement of the engine. Most commercially available variable displacement engines are arranged to deactivate a fixed set of the cylinders during certain low-load operating conditions. When a cylinder is deactivated, its piston typically still reciprocates, however neither air nor fuel is delivered to the cylinder so the piston does not deliver any power during its power stroke. Since the cylinders that are "shut down" don't deliver any power, the proportionate load on the remaining cylinders is increased, thereby allowing the remaining cylinders to operate at an improved thermodynamic efficiency. The improved thermodynamic efficiency results in improved fuel efficiency.

Typically, a variable displacement engine will have a very small set of available operational modes. For example, some commercially available 8 cylinder variable displacement engine are capable of operating in a 4 cylinder mode in which only four cylinders are used, while the other four cylinders are deactivated (a 4/8 variable displacement engine). Another commercially available variable displacement engine is a 3/4/6 engine which is a six cylinder engine that can be operated with 3, 4, or 6 active cylinders. Of course, over the years, a variety of other fixed cylinder set variable displacement engines have been proposed as well, with some suggesting the flexibility of operating with any number of the cylinders. For example, a 4 cylinder engine might be operable in 1, 2, 3, or 4 cylinder modes.

Another engine control approach that varies the effective displacement of an engine is referred to as "skip fire" engine control. In general, skip fire engine control contemplates selectively skipping the firing of certain cylinders during selected firing opportunities. Thus, a particular cylinder may be fired during one firing opportunity and then may be skipped during the next firing opportunity and then selectively skipped or fired during the next. In this manner, even finer control of the effective engine displacement is possible. For example, firing every third cylinder in a 4 cylinder engine would provide an effective displacement of $1/3^{rd}$ of the full engine displacement, which is a fractional displacement that is not obtainable by simply deactivating a set of cylinders.

In general, skip fire engine control is understood to offer a number of potential advantages, including the potential of significantly improved fuel economy in many applications. Although the concept of skip fire engine control has been around for many years, and its benefits are understood, skip fire engine control has not yet achieved significant commercial success in part due to the challenges it presents. In many applications such as automotive applications, one of the most significant challenges presented by skip fire engine operation relates to NVH (noise, vibration & harshness) issues. In general, a stereotype associated with skip fire engine control is that skip fire operation of an engine will make the engine run significantly rougher than conventional operation.

Co-assigned U.S. Pat. Nos. 7,577,511, 7,849,835, 7,886,715, 7,954,474, 8,099,224, 8,131,445, 8,131,447 and other co-assigned patent applications describe a new class of engine controllers that make it practical to operate a wide variety of internal combustion engines in a skip fire operational mode. Although the described controllers work well, there are continuing efforts to further improve the technology and/or to provide alternative approaches to implementing such control. The present application describes a variety of arrangements that can be used to determine and/or control the firing fraction of an engine operating in a skip fire operational mode.

SUMMARY

The described embodiments relate generally to skip fire control of internal combustion engines and particularly to mechanisms for determining a desired operational firing fraction. In some embodiments, a firing fraction determining unit is arranged to determine a firing fraction suitable for delivering a requested engine output. The firing fraction determining unit may utilize data structures such as lookup tables in the determination of the desired firing fraction. A firing controller may then be arranged to direct firings in a skip fire manner that delivers the desired operational firing fraction.

In one aspect the desired engine output and one or more operational power train parameters such as current engine speed, are used as indices to a lookup table used to select a desired firing fraction. In some embodiments, transmission gear serves as another index to the lookup table. In other embodiments, additional indices to the data structure may include any one of: manifold absolute pressure (MAP); cam position; a parameter indicative of mass air charge (MAC); cylinder torque output; maximum permissible manifold pressure; vehicle speed; estimated manifold temperature; and barometric pressure.

In some embodiments, the lookup table is arranged to dictate operation in an all-cylinder operational mode in selected operational states. When all-cylinder operation is directed, the output of the engine may be modulated primarily based on throttle position.

In selected embodiments, each entry in the lookup table includes a firing fraction field that stores an associated firing fraction indicator indicative of a desired firing fraction associated with such entry. In some embodiments, the table entries may further include a second field arranged to store a value indicative of a second desired operational parameter. For example, the second field may be a MAC field arranged to store a MAC indicator indicative of a desired operational mass air charge. When used, the MAC indicator may be a relative or fixed reference value.

In another aspect, methods of determining a desired operational firing fraction are described. In some embodiments, lookup tables such as those described above are used in the determination of the firing fraction.

In one specific embodiment a desired engine output is determined in terms of a desired engine torque fraction. The desired torque fraction is indicative of the desired engine output relative to a reference maximum available engine output. A desired operational firing fraction is then determined based at least in part on the desired torque fraction and engine speed. Cylinder firings are then directed in a skip fire manner that delivers the desired engine output by firing the percentage of available working cycles indicated by the desired operational firing fraction.

BRIEF DESCRIPTION OF THE DRAWINGS

The invention and the advantages thereof, may best be understood by reference to the following description taken in conjunction with the accompanying drawings in which:

FIG. 2 is a representation of a table data structure suitable for use in determining the firing fraction in accordance with one described embodiment of the present invention.

FIG. 4 is a representation of a table data structure suitable for use in determining the firing fraction in accordance with a third embodiment.

FIG. 6 is a representation of a table data structure suitable for use in determining a minimum firing faction in accordance with one described embodiment of the present invention.

In the drawings, like reference numerals are sometimes used to designate like structural elements. It should also be appreciated that the depictions in the figures are diagrammatic and not to scale.

DETAILED DESCRIPTION

The present invention relates generally to methods, data structures and devices for determining the firing fraction in skip fire control.

Figure 1A:
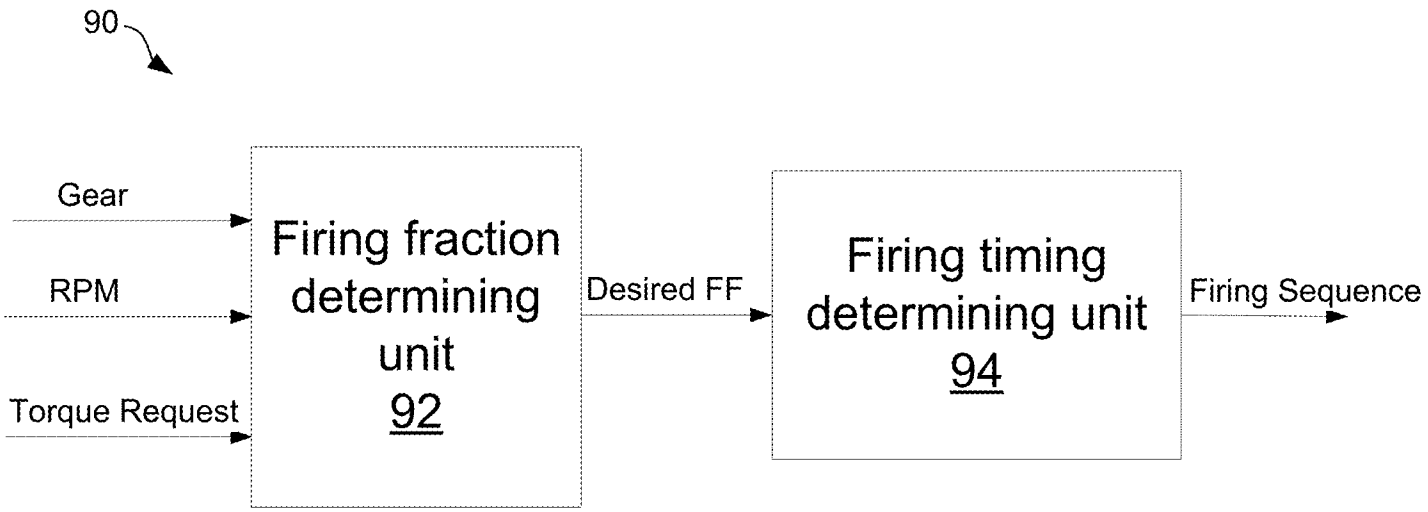
FIG. 1A is a block diagram of a skip fire engine controller that incorporates a firing fraction calculator in accordance with some embodiments of the present invention.

FIG. 1A is a block diagram that diagrammatically illustrates a representative skip fire controller that utilizes a firing fraction calculator in accordance with one described embodiment. The skip fire controller 90 includes a firing fraction determining unit 92 (sometimes referred to as a firing fraction calculator) and a firing timing determining unit 94. The firing fraction calculator 92 is arranged to determine a firing fraction that is suitable for delivering the desired engine output and informs the firing timing determining unit 94 of the desired firing fraction. The firing timing determining unit 94 is responsible for determining a firing sequence that delivers the desired firing fraction. The firing sequence can be determined using any suitable approach. In some implementations, the firing may be determined dynamically on an individual firing opportunity by firing opportunity basis as described in some of the incorporated patents. In others, pattern generators or predefined patterns may be used to facilitate deliver of the desired firing fraction.

Figure 1B:
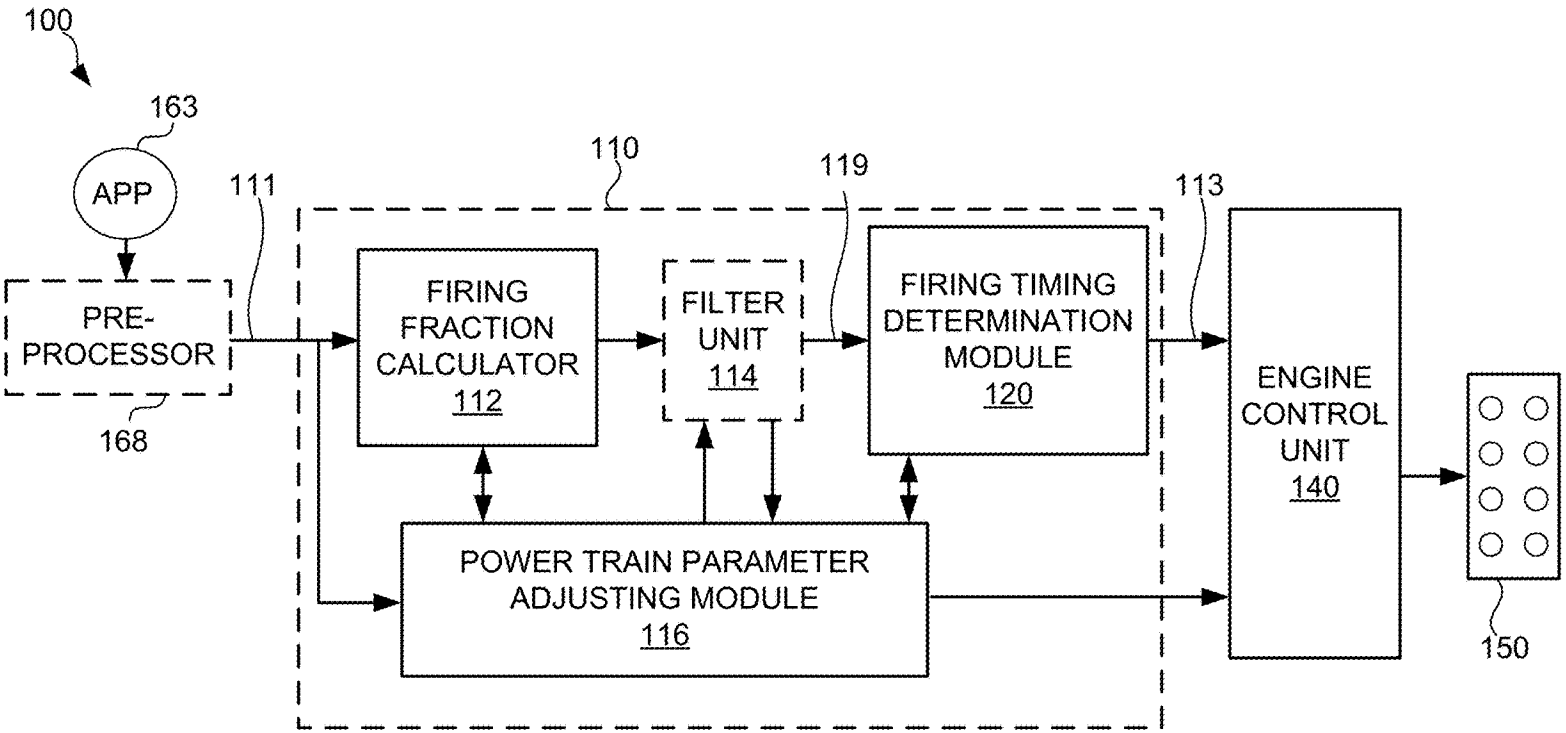
FIG. 1B is a block diagram of another exemplary skip fire engine controller that incorporates a firing fraction calculator.

Referring next to FIG. 1B, another skip fire engine controller that incorporates a firing fraction calculator will be described. In this embodiment, the controller 100 includes a skip fire controller 110 arranged to work in conjunction with an engine control unit (ECU) 140. In other embodiments, the functionality of the skip fire controller 110 may be incorporated into the ECU 140. The illustrated skip fire controller 110 includes a firing fraction calculator 112, an optional filter unit 114, a power train parameter adjusting module 116, and a firing timing determining module 120. The skip fire controller receives an input signal 111 indicative of a desired engine output and is arranged to generate a sequence of firing commands that cause an engine 150 to provide the desired output using a skip fire approach.

In the embodiment of FIG. 1B, the input signal 111 is treated as a request for a desired engine output. The signal 111 may be received or derived from an accelerator pedal position sensor (APP) or other suitable sources, such as a cruise controller, a torque calculator, an ECU, etc. In FIG. 1B an optional preprocessor 168 may modify the accelerator pedal signal prior to delivery to the skip fire controller 110. However, it should be appreciated that in other implementations, the accelerator pedal position sensor 163 may communicate directly with the skip fire controller 110.

The desired engine output may also be based on factors in addition to, or instead of the accelerator pedal position. For example, in some embodiments, current operational conditions such as engine speed, vehicle speed and/or gear may be used in conjunction with the accelerator pedal position when determining the desired engine output. Similarly, various environmental conditions such as barometric pressure, ambient temperature, etc. may be used in substantially the same way. Additionally or alternatively, it may be desirable to account for the energy required to drive engine accessories, such as the air conditioner, alternators/generator, power steering pump, water pumps, vacuum pumps and/or any combination of these and other components. Appropriate determination of these accessory losses may be accomplished by a torque calculator, the ECU or other suitable components. Such a torque calculator, etc. can be arranged to provide the firing fraction calculator 112 with a single value/signal indicative of the total requested torque, (e.g., in place of signal 111) or to provide one or more separate values/signals (not shown) to the firing fraction calculator 112 such that the firing fraction calculator itself determines the total requested torque based on multiple inputted torque requests. By way of example, co-owned patent application No. 61/682,135 (which is incorporated herein by reference)

discloses some torque calculators that can be used to determine the desired engine output. In still other embodiments, the desired engine output signal 111 or a supplemental input signal may come from a cruise controller, a transmission controller, a traction control system (to reduce wheel slippage) and/or from any other suitable source.

The firing fraction calculator 112 receives input signal 111 (and when present other suitable sources) and is arranged to determine a skip fire firing fraction that would be appropriate to deliver the desired output under selected engine operating conditions. The firing fraction is indicative of the fraction or percentage of firings under the current (or directed) operating conditions that are required to deliver the desired output. In some preferred embodiments, the firing fraction may be determined based on the percentage of optimized firings that are required to deliver the driver requested engine torque (e.g., when the cylinders are firing at an operating point substantially optimized for fuel efficiency). However, in other instances, different level reference firings, firings optimized for factors other than fuel efficiency, the current engine settings, etc. may be used in determining the appropriate firing fraction.

In the illustrated embodiment, an optional power train parameter adjusting module 116 is provided that cooperates with the firing fraction calculator 112. The power train parameter adjusting module 116 directs the ECU 140 to set selected power train parameters appropriately to insure that the actual engine output substantially equals the requested engine output at the commanded firing fraction. By way of example, the power train parameter adjusting module 116 may be responsible for determining the desired mass air charge (MAC) and/or other engine settings that are desirable to help ensure that the actual engine output matches the requested engine output. Of course, in other embodiments, the power train parameter adjusting module 116 may be arranged to directly control various engine settings.

The firing timing determining module 120 is arranged to issue a sequence of firing commands (e.g., drive pulse signal 113) that cause the engine to deliver the percentage of firings dictated by a commanded firing fraction 119. The firing timing determining module 120 may take a wide variety of different forms. By way of example, sigma delta convertors work well as the firing timing determining module 120. A number of the assignee's patents and patent applications describe various suitable firing timing determining modules, including a wide variety of different sigma delta based converters that work well as the firing timing determining module. See, e.g., U.S. Pat. Nos. 7,577,511, 7,849,835, 7,886,715, 7,954,474, 8,099,224, 8,131,445, 8,131,447 and application Ser. No. 13/774,134, each of which is incorporated herein by reference. The sequence of firing commands (sometimes referred to as a drive pulse signal 113) outputted by the firing timing determining module 120 may be passed to an engine control unit (ECU) or combustion controller 140 which orchestrates the actual firings.

In the embodiment illustrated in FIG. 1B, the output of the firing fraction calculator 112 is optionally passed through a filter unit 114 before it is delivered to the firing timing determining module 120. The filter unit 114 is arranged to mitigate the effect of any step change in the commanded firing fraction such that the change in firing fraction is spread over a longer period. This "spreading" or delay can help smooth transitions between different commanded firing fractions and can also be used to help compensate for mechanical delays in changing the engine parameters.

In particular the filter unit 114 may include a first filter that smoothes the abrupt transition between different commanded firing fractions to provide better response to engine behavior and so avoid a jerky transient response. In some circumstances, a change in the commanded firing fraction and/or other factors will cause the power train adjusting module 116 to direct a corresponding change in the engine (or other power train) settings (e.g., throttle position which may be used to control manifold pressure/mass air charge). To the extent that the response time of the first filter is different than the response time(s) for implementing changes in the directed engine setting, there can be a mismatch between the requested engine output and the delivered engine output. Indeed, in practice, the mechanical response time associated with implementing such changes is much slower than the clock rate of the firing control unit. For example, a commanded change in manifold pressure may involve changing the throttle position which has an associated mechanical time delay. Once the throttle has moved there is a further time delay to achieve of the desired manifold pressure. The net result is that it is often not possible to implement a commanded change in certain engine settings in the timeframe of a single firing opportunity. If unaccounted for, these delays would result in a difference between the requested and delivered engine outputs. The filter unit 114 may also include a second filter to help reduce such discrepancies. More specifically, the second filter may be scaled so its output changes at a similar rate to the engine behavior; for example, it may substantially match the intake manifold filling/discharge dynamics. The filters within the filter unit 114 may be constructed in a wide variety of different manners.

The firing fraction calculator 112, the filter unit 114, and the power train parameter adjusting module 116 may take a wide variety of different forms and their functionalities may alternatively be incorporated into an ECU, or provided by other more integrated components, by groups of subcomponents or using a wide variety of alternative approaches. In various alternative implementations, these functional blocks may be accomplished algorithmically using a microprocessor, ECU or other computation device, using analog or digital components, using programmable logic, using combinations of the foregoing and/or in any other suitable manner.

In still other implementations, the firing fraction calculator 112 may be arranged to determine a "requested" firing fractions in terms of a reference cylinder output. When a reference cylinder output is used, the reference can be a fixed value or it may be variable based on selected powertrain, vehicle or environmental parameters/conditions. The requested firing fraction may then be used in the selection of an operational firing fraction which might have preferred attributes (such as better NVH characteristics). When such an adjustment is made to the requested firing fraction, it is typically desirable to adjust other engine or powertrain parameters correspondingly to insure that desired engine output is actually delivered. By way of example, such architecture is described in co-assigned patent application Ser. Nos. 13/654,244 and 13/654,248 which are incorporated herein by reference.

Another specific skip fire controller implementation will be described next with reference to FIG. 1C. In this embodiment, a torque calculator 175 is used to determine a desired engine output 111(*c*) that is provided to the firing fraction calculator 112. In other respects the components of the skip fire controller 110(*c*) may be similar to described above with respect to FIG. 1A or 1B.

Figure 1C:
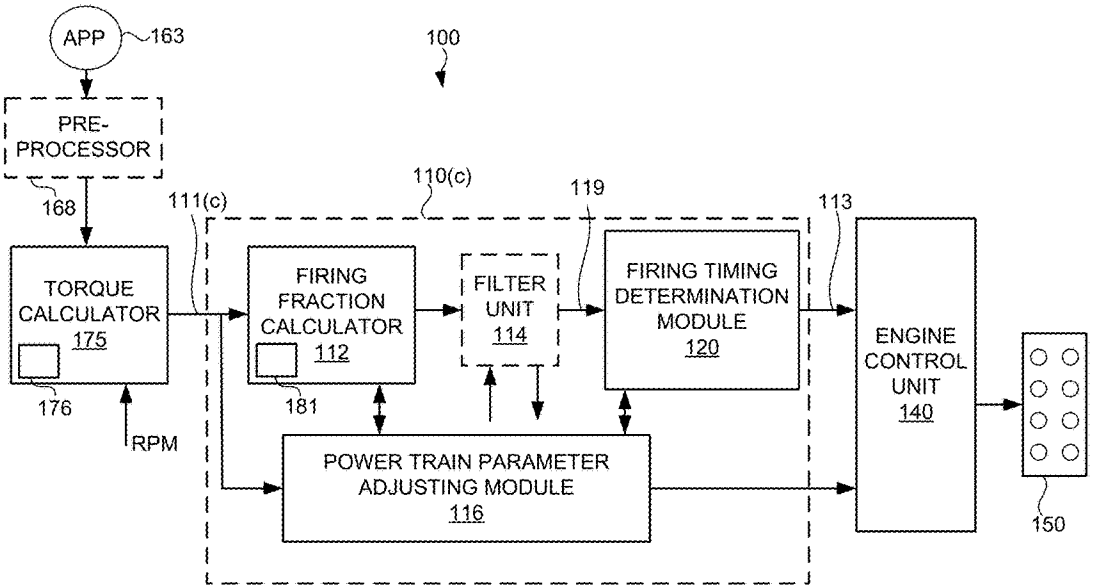
FIG. 1C is a block diagram of another exemplary skip fire engine controller that incorporates a torque calculator.

In the embodiment of FIG. 1C, the accelerator pedal position (APP) and vehicle speed (RPM) are used as indices into a lookup table 176 that returns a target throttle position (TP). This table is designed to give good drivability and such tables are implemented in various commercially available engines. For a given target throttle position (TP) and engine speed, a target or desired torque can be determined. The desired torque can be calculated algorithmically, obtained from a lookup table or in any other suitable manner. In the described implementation, the desired torque is characterized as a fraction—specifically, the fraction or percentage of the torque generated under reference or nominal cylinder conditions. (Note that the fraction can potentially be greater than one). In other embodiments the desired output may be characterized in other ways—such as the number of cylinders required (e.g., 3.1) out of the total number of cylinders, a total torque output, or in other ways. The reference cylinder conditions may be a set predefined value or a value that varies with certain environmental or operational conditions (e.g., barometric pressure, engine speed, etc.).

Optionally, the torque calculator 175 may be arranged to account for the load utilized by engine accessories by adding estimates that account for the energy required to drive such accessories to the driver requested output indicated by the accelerator pedal position when determining the desired torque fraction. Additionally, the torque calculator 175 may be arranged to consider inputs from other control systems within the vehicle when determining the desired torque. Such inputs may be intended to override or supplement the desired output as indicated by the accelerator pedal position. By way of example, an ECU or transmission controller may request transitory torque reductions during transmission shifts; a traction controller may request reduced or specific engine output during potential traction loss events; and/or a cruise controller may direct engine output while the vehicle is under cruise control.

In the embodiment of FIG. 1C, the firing fraction calculator 112 uses the desired torque fraction 111(*c*) (desired engine output) provided by torque calculator 175 to determine the desired firing fraction. The appropriate firing fraction for a given torque fraction may vary somewhat based on selected operational condition such as engine speed (and potentially gear) and thus the lookup tables used may have multiple indices—as for example desired torque fraction (i.e., desired engine output) and RPM in some particular implementations.

In some implementations it may be desirable to only use skip fire control when the engine is operating in a particular range of conditions—as for example at an engine speed within a permissible range. Minimum and maximum engine operating speeds for skip fire operation can be incorporated into the firing fraction table by dictating all cylinder (or reduced cylinder) operation at specific engine speeds or under specific operating conditions. For NVH considerations it may be desirable to require the use of a minimum firing fraction (which may vary based on factors such as engine speed and gear). It should be appreciated that such minimums also may readily be incorporated into the firing fraction tables. The firing fraction tables may be arranged to assume a nominal or reference engine settings, or may be arranged to direct the associated engine settings.

In some embodiments, the desired firing fraction is then sent to the firing timing determination module. In other embodiments, to help address NVH concerns, it may be desirable to only utilize firing fractions selected from a set of available operational firing fractions. In such embodiments, the desired firing fractions may be used in the selection of an operational firing fraction. Simultaneously, various engine settings such as valve (cam) timing, throttle position, and/or spark timing may be adjusted appropriately to insure that the engine delivers the desired output at the operational firing fraction. By way of example, such arrangements are described in co-assigned patent Ser. Nos. 13/654,244 and 13/654,248 which are incorporated herein by reference.

Although not required in all implementations, the torque determination, the firing fraction determination and the determination of whether to skip or fire a cylinder during any particular working cycle are preferably made individually on a working cycle by working cycle basis. That is, the torque and firing fraction determinations are preferably updated each firing opportunity and the firing decision is preferably made each firing opportunity. Thus, in the context of the firing fraction calculator 112, the currently desired firing fraction can be re-determined before each firing opportunity. Facilitating such dynamic tracking of the desired firing fraction allows the controller to be particularly responsive to changing demands while maintaining the benefits of skip fire operation. Although firing opportunity by firing opportunity updates are desirable in many applications, it should be appreciated that in alternative embodiments, any of the updated calculations and/or the firing decisions may be made less frequently as appropriate for any particular skip fire controller.

Firing Fraction Determining Unit

There are a number of factors that may influence the desired firing fraction. These typically include the requested engine output (which is often determined in large part based on accelerator pedal position) and selected power train operating parameters such as current engine speed (e.g., RPM) and/or the current transmission gear. The firing fraction determining unit 112 is arranged to determine the desired firing fraction based on such factors and/or any other factors that the skip fire controller designer may consider important.

In some embodiments, the firing fraction determining unit 112 is arranged to utilize a lookup table to determine the desired firing fraction. By way of example, FIG. 2 diagrammatically illustrates a lookup table 200 that may be used to determine the appropriate firing fraction in some implementations. The lookup table can be implemented in any appropriate type of memory using a variety of conventional table constructs. In the embodiment illustrated in FIG. 2, three independent indices are provided and each table entry 203 has a firing fraction field 204 that stores a firing fraction indicator value 205 which indicates the desired firing fraction associated with that entry. The first index 207 is based on a requested engine output which as described above, may be determined in any suitable manner by the torque calculator, a accelerator pedal position sensor or by any other appropriate component. The second index 209 is based on a first power train operating parameter—specifically, engine speed in the illustrated embodiment. The third index 211 is based on a second power train operating parameter—specifically, transmission gear. In other embodiments, various other indices based on other power train operating parameters may be used in addition to, or in place of one or more of the described indices. Furthermore, ambient environmental conditions, such as ambient air pressure (which varies with altitude and other factors) and/or ambient air temperature may be used as table indices in addition to engine and vehicle operational parameters.

The requested engine output index value can be based on a wide variety of different inputs. For example, in some embodiments, the requested engine output index may be directly or indirectly based on the output of the accelerator pedal position sensor. In other embodiments, the requested engine output may be indicative of a requested torque or other indicator of desired engine output. Such a request could come from a cruise controller, the ECU, a torque calculator, a logic block (e.g. a preprocessor) that converts the pedal position sensor signal to a requested torque, a traction control system or from any other suitable source. In other embodiments, the firing fraction calculator (or a torque calculator that determines the total requested torque) may be arranged to sum the torque request from multiple sources and/or to otherwise determine, calculate or select a desired engine output based on current operating conditions using any criteria that may be deemed appropriate by the engine control designer. The requested engine output may be provided in terms of an absolute number (e.g., a particular requested torque), in terms of a fraction or percentage (e.g., a particular torque fraction as described above with respect to FIG. 1C), or in any other manner and the tables may be scaled accordingly.

It should be appreciated that there are a number of factors in addition to the requested engine output that may influence the desired firing fraction. For example, various power train operating parameters such as current engine speed (e.g., RPM) and/or the current transmission gear may influence the desired firing fraction. Operational conditions such as the torque output of each cylinder, or factors that influence that output such as the mass air charge (MAC), cam position (e.g. cam phaser position), manifold absolute pressure (MAP), and/or estimated manifold temperature could be used as indices as well. In the embodiment illustrated in FIG. 2, engine speed and transmission gear that is currently in use are used as additional indices for the lookup table 200 so that the firing fraction can be better tailored to the vehicle current operating state at any given time.

The engine speed can be useful for several reasons. Initially, it may be desirable to require a minimum firing fraction even when the requested engine output is low, as for example at idle or engine speeds below a designated threshold (e.g., 1000 or 1500 RPM, etc.). This can be helpful to mitigate NVH issues. For example, higher engine speeds have higher firing frequencies (for a given firing fraction)—which tend to have better vibration characteristics in the frequency ranges that are most noticeable to passengers. Furthermore, for a given requested engine output, the firing fraction that is desirable for an engine that is currently operating at 1500 RPM may be higher than the desirable firing fraction at a higher engine speed (e.g., 4000 RPM).

The transmission gear can also be an important factor when determining the desired firing fraction. One reason that transmission gear can be important is that different gears tend to have different NVH (noise, vibration and harshness) characteristics. That is, different gears may have different vibration and/or acoustic characteristics given similar operating parameters such as engine speed, firing fraction, etc. For example, a certain firing fraction may run smoothly in $4^{th}$ gear at a particular engine speed, while the same firing fraction may generate undesirable vibrations in another gear at the same engine speed. This is, in part, because the same torque pulse generated from an engine will be transferred to the driveline differently by different gears.

The described lookup tables can be used to implement a wide variety of different firing fraction determining algorithms. One of the advantages of the described lookup table approach is that the correlations between specific operating parameters and the directed firing fraction can be defined in any manner deemed appropriate by the engine controller designer. This allows the designer to determine the desired mappings between various operating parameters and the desired firing fraction experimentally, analytically or using any combination of such approaches. Accessing the tables is a time and processing efficient mechanism for determining the firing fraction since the tables can be accessed very quickly, which facilitates firing opportunity by firing opportunity updating of the desired firing fraction. Thus, if desired, the "current" firing fraction can be determined and updated before each firing opportunity. Of course, the tables can also readily be used in other implementations, where such frequent re-determination of the desired firing fraction is not necessary. The use of lookup tables also allows the entry values and thus the desired mappings to be easily updated if desired. For example, the tables could be updated, if desired, as part of vehicle maintenance. Additionally, multiple tables can be provided for use under different driving or environmental conditions.

The lookup table can be implemented as a single multi-dimensional lookup table, or may be constructed as a set of different lookup tables that are each associated with a particular operating parameter. For example, a separate lookup table may be provided for use with each transmission gear, etc. For the purposes of this application—table structures that utilize physically separate lookup tables based on a particular parameter (e.g. a separate physical or logical table for each gear) are considered conceptually the same as a multi-dimensional lookup table that utilizes that particular parameter (gear in the given example) as an additional index. Thus, the term "multi-dimensional lookup table" as used herein is intended to encompass any data structure or set of data structures that are arranged to be accessed using two or more different variables (e.g. indices). These may include physically or logically separated tables, arrays, etc.

In the embodiment described above, one of the indices to the table is based on engine speed or RPM. In other embodiments, such an index can be based on a value that is directly or indirectly indicative of engine speed such as the rotational speed of a camshaft, the rotational speed of a drive train component, etc. or even vehicle speed.

In some embodiments, the inputs to the firing fraction calculator 112 may be quantized and the table may be sized appropriately so that all possible input parameters are explicitly defined in the lookup table. In other embodiments, conventional interpolation techniques may be used to determine the desired firing fraction based on the nearest available table entries. In the table shown in FIG. 2, only a few entries are provided for each index value for illustrative purposes. Even when such coarse index steps are provided in the table, standard interpolation techniques can be used to determine the appropriate firing fractions for intermediate conditions. In practice it will often be desirable to have much finer steps between table index values and the ranges of values will vary widely based on the expected operational range of the engine's skip fire control.

As will be appreciated by those familiar with skip fire engine control, low (but non-zero) firing fractions can sometimes have poor vibration characteristics, particularly when the engine is operating at a relatively low engine speed. Therefore, in some implementations it will be desirable to dictate a minimum firing fraction or firing frequency. When a minimum firing fraction is used, it may be desirable to reduce the output of each firing appropriately so that the total engine output matches the desired output with the minimum firing fraction in place. This can readily be accomplished by adjusting other parameters such as the spark timing, mass air charge (MAC), cam phaser position, cam lift, or intake manifold absolute pressure (MAP) in conjunction with the firing fraction. A number of approaches can be used to appropriately control the output of each firing. By way of example, in one approach, the lookup tables may be arranged to set the firing fraction to a desired minimum firing fraction for the associated engine speed in response to relatively small torque requests. Another component or logical block (such as power train parameter adjusting module 116 or ECU 140) may then be arranged to set other engine parameters as appropriate to insure that the engine delivers the desired output at the requested firing fraction.

In the illustrated embodiment, a number of the firing fraction values in the table are identified as "1"—which means that all of the cylinders would be fired all of the time. See in particular, the lower right quadrant of the Gear 6 table illustrated in FIG. 2. In some circumstances the torque request associated with a "1" simply cannot be met by the engine at the associated engine speed (which would be especially true for the entries in the lower right corner of that table). In other circumstances adjusting other engine parameters in conventional ways—such as by advancing the camshaft or increasing the mass air charge can be used to provide the desired engine torque.

Figure 3:
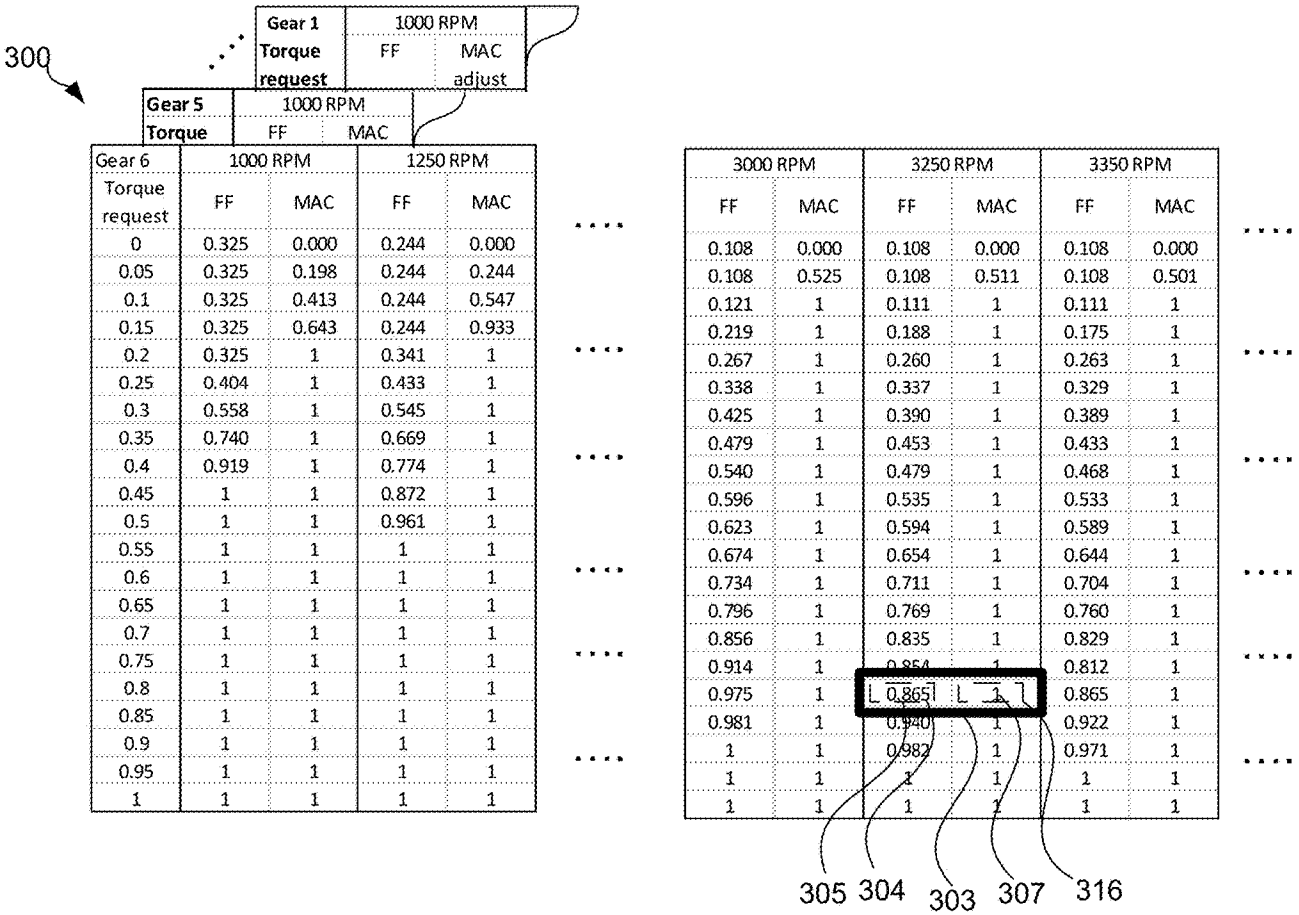
FIG. 3 is a representation of a table data structure suitable for use in determining the firing fraction in accordance with another embodiment.

In a different approach, the lookup tables themselves may be arranged to define other operating parameters in addition to the firing fraction. One such arrangement is illustrated in FIG. 3 which shows a table 300 that defines a relative desired mass air charge in addition to the firing fraction. Specifically, in the illustrated embodiment, each table entry 303 has two separate fields. The first field is a firing fraction (FF) field 304 that holds a firing fraction indicator value 305 as described above with respect to FIG. 2. The second field is a relative MAC field 316 which stores an indicator of the relative percentage of a designated reference MAC 307 which is to be used in conjunction with the designated firing fraction. This field is sometimes referred to herein as the MAC adjust field and is labeled "MAC" in the table of FIG. 3.

The reference MAC may be a fixed absolute value, however more frequently it would be a value that is determined based on current operating conditions. In some preferred embodiments, the reference MAC is a mass air charge that facilitates operation of the cylinders under substantially optimal conditions (thermodynamic or otherwise). For example, the reference mass air charge may be set to equal the mass air charge that provides substantially the highest thermodynamic (fuel) efficiency at the current operating state of the engine (e.g., engine speed, environmental conditions, etc.). However, it should be appreciated that the reference MAC may be optimized for other factors including emissions, vibration considerations, total torque output or may be optimized in a manner that accounts for multiple factors including these and various environmental and operational features such as altitude or desired intake manifold vacuum levels. Regardless of how the reference MAC is determined, it should be appreciated that the reference MAC may be a variable that varies with the operational state of the engine. For example, the engine speed and ambient barometric pressure are two factors that can affect the optimal MAC at any given time.

In the illustrated embodiment, the value stored in relative MAC Adjust field 316 is a relative value which indicates a fraction or percentage of the reference MAC that is to be used rather than an absolute value of the MAC. The relative value is particularly useful in embodiments that utilize a variable reference MAC so that the actual engine output scales appropriately. However, it should be appreciated that in alternative embodiments, set MAC values may be used. Regardless of whether a fixed or relative value of the MAC is provided in the table 300, the engine controller may be arranged to adjust the engine settings (e.g., throttle position, valve timing, etc.) in a manner that causes the desired MAC to be delivered to the operating cylinders. Such adjustments may be controlled by the power train parameter adjusting module 116, the ECU 140, the firing fraction calculator 112 or by any other appropriate component using conventional engine settings control techniques.

In the embodiment illustrated in FIG. 3, the second field of each table entry is the relative MAC. More generally, the lookup table may be arranged to provide values indicative of any desired operating parameters, or values that might be useful in calculating the appropriate values of such other desired operating parameters may be included together with the firing fraction indications. Such other operating parameter values may be provided in addition to or in place of the relative MAC. Additional operating parameters can readily be controlled by providing additional fields within each entry to define the other desirable parameters. By way of example, a relative manifold absolute pressure (e.g. relative to barometric pressure), in conjunction with information about the intake and exhaust valve timing may readily be used in place of the MAC. In engines that utilize cam shafts that facilitate variable valve lift, it may sometimes be desirable to advance or retard the cam to modify the timing of the intake and exhaust valve opening and closing events. In such embodiments, another table value could be indicative of the desired cam advance (or cam phasing). The amount of fuel injection and the ignition timing, for spark ignition engines are examples of some other engine operating parameters that may be desirable to specify in some specific implementations.

In the embodiment of FIG. 3, most of the MAC Adjust fields 316 are shown as storing the value "1" which indicates that the reference MAC is to be used. When an optimized MAC is used as the reference MAC this permits the engine to operate under near optimal conditions over most of its operating range. However, in regions where the torque request is relatively low and a minimum firing fraction is being used, the MAC is adjusted to modulate the engine output. In other embodiments, NVH considerations may make it desirable to utilize only a limited set of firing fractions or to avoid the use of certain firing fractions under selected operating condition. In such embodiments, the table may be arranged to more actively vary the relative MAC (or other controlled power train parameters) as a function of the torque request. Such a table is illustrated in FIG. 4.

In the table illustrated in FIG. 4 the torque request index has finer granularity than the associated firing fraction (FF) values. So as to control the engine in a manner where the delivered torque substantially matches the torque request, the MAC adjust values are appropriately adjusted. When the engine is operating at the specified firing fraction and MAC adjust values it will substantially deliver an output torque which matches the torque request. MAC adjust values greater than 1 are possible because the reference MAC may not correspond to the absolute maximum MAC value.

In the embodiment of FIG. 2 a lookup table is used to determine the desired firing fraction. In other designs it may be desirable to determine the firing fraction algorithmically or in other suitable manners based on a combination of some of the described factors (e.g., desired output, engine speed and gear). This may be accomplished by using a variety of different approaches. By way of example, in some embodiments each transmission gear may have a predefined set of firing fractions that may be use for different engine speeds.

The appropriate firing fraction can then algorithmically be determined based on the current torque request.

Figure 5:
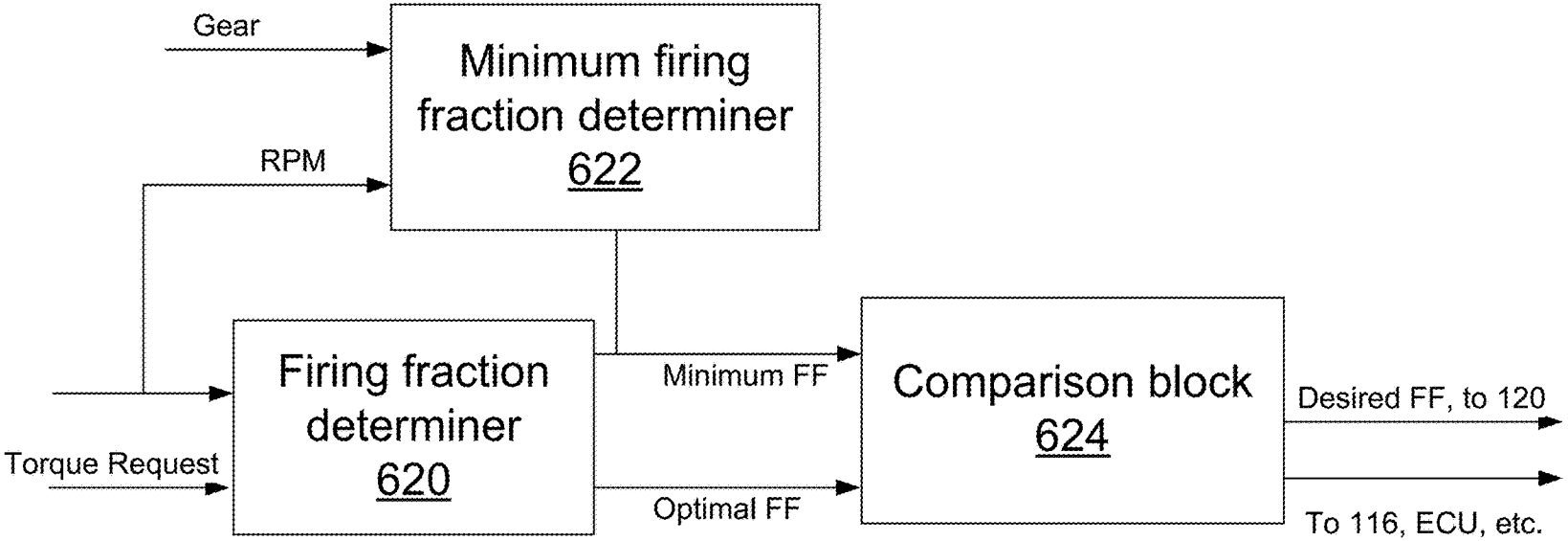
FIG. 5 is a functional block diagram showing a firing fraction control structure in accordance with another embodiment.

Referring next to FIG. 5, another approach to determining the desired firing fraction will be described. In this embodiment, a firing fraction determiner 620 is arranged to calculate an optimal firing fraction given the engine RPM and torque request. The optimal nature of this calculation may be with respect to fuel efficiency, emissions, vibrations, or any other desired factor or any combination of these and other factors. The firing fraction determining block 620 can be implemented algorithmically on a processor, using equations, using a lookup table as shown in FIG. 2, using a lookup table with interpolation, or using any other suitable method. In parallel with determining the optimal firing fraction, the minimum firing fraction is determined by a minimum firing fraction determiner block 622. This block takes the vehicle gear, the RPM, and optionally other variables such as nominal mass air charge as inputs. Based on these inputs, the minimum firing fraction determiner block determines a minimum allowed firing fraction. It can be implemented with equations, a lookup table as diagrammatically illustrated in FIG. 6, (with or without interpolation) or using other suitable approaches.

Once both the optimal firing fraction and the minimum firing fraction are determined, they are input to a comparison block 624, the output of which is the maximum firing fraction of the two. The desired firing fraction may be directed to an appropriate firing timing determining module 120 as previously described. When the minimum firing fraction is used (or in any other situation in which the desired firing fraction is larger than the optimal firing fraction), the comparison block 624 so informs a power train parameter adjusting module 116 or other appropriate component (e.g., the ECU) which in turn is arranged to adjust other engine parameters such that the target manifold absolute pressure and/or cam settings, etc. to effectively adjust the mass air charge in a manner such that the directed firing fraction produces the requested torque or power.

Other Features

Although only a few embodiments of the invention have been described in detail, it should be appreciated that the invention may be implemented in many other forms without departing from the spirit or scope of the invention. For example, although a few particular skip-fire engine controllers that are suitable for utilizing the described firing fraction calculators have been described, and others are described in some of the incorporated patents, it should be appreciated that the described firing fraction calculators can be used with a wide variety of different skip-fire controllers and it is not limited to use with the described classes of skip fire controllers.

An advantage of using the various described lookup table based approaches to the firing fraction determination is that the table designer has wide flexibility in defining the desired firing fraction for specific operational conditions. Such deterministic control tends to be more difficult to implement using logic based approaches when calculation of the desired firing fraction is not susceptible to simple algorithmic definition. The described approach also allows the skip fire controller to utilize a fairly wide range of firing fractions when desired.

In the illustrated embodiments, only a few specific indices such as desired engine output, engine speed and gear are described. However, it should be appreciated that a wide variety of other parameters can be used in other embodiments to meet the needs of any particular embodiment. For example, powertrain or vehicle parameters such as manifold absolute pressure (MAP), mass air charge (MAC), cam phase settings, throttle position, cylinder torque output, engine torque output, vehicle speed and estimated manifold temperature can be used in particular implementations. Similarly environmental parameters such as ambient barometric pressure may be used. Of course, other relevant parameters may be used as indices as well.

There are a number of vehicle systems that require the use of a vacuum. Often that vacuum is effectively provided by the intake manifold and particularly by a reduced pressure in the manifold that is generated by partially closing the throttle. In contrast, higher manifold pressures are generally preferable from a fuel efficiency standpoint. The competing interests of (i) the desire for improved fuel efficiency, and (ii) the need (typically occasional) for a vacuum source—makes it desirable in some applications to be able to dictate a maximum manifold pressure at certain times. Such an approach is described, for example, in co-assigned Provisional Patent Application No. 61/682,168 which is incorporated herein by reference. Changing the manifold pressure (MAP) inherently affects the output of each firing and therefore affects the firing fraction that is necessary to generate a particular desired engine output. Such constraints can readily be accommodated using the described approach by including another table dimension based on maximum allowed manifold pressure.

Although skip fire management is described, it should be appreciated that in actual implementations, skip fire control does not need to be used to the exclusion of other types of engine control. For example, there will often be operational conditions where it is desirable to operate the engine in a conventional (fire all cylinders) mode where the output of the engine is modulated primarily by the throttle position as opposed to the firing fraction. Additionally, or alternatively, when a commanded firing fraction is coextensive with an operational state that would be available in a standard variable displacement mode (i.e., where only a fixed set of cylinders are fired all of the time), it may be desirable to operate only a specific pre-designated sets of cylinders to mimic conventional variable displacement engine operation at such firing fractions.

The invention has been described primarily in the context of controlling the firing of 4-stroke piston engines suitable for use in motor vehicles. However, it should be appreciated that the described approaches are very well suited for use in a wide variety of internal combustion engines. These include engines for virtually any type of vehicle—including cars, trucks, boats, aircraft, motorcycles, scooters, etc.; for non-vehicular applications such as generators, lawn mowers, models, etc.; and virtually any other application that utilizes an internal combustion engine. The various described approaches work with engines that operate under a wide variety of different thermodynamic cycles—including virtually any type of two stroke piston engines, diesel engines, Otto cycle engines, Dual cycle engines, Miller cycle engines, Atkins cycle engines, Wankel engines and other types of rotary engines, mixed cycle engines (such as dual Otto and diesel engines), hybrid engines, radial engines, etc. It is also believed that the described approaches will work well with newly developed internal combustion engines regardless of whether they operate utilizing currently known, or later developed thermodynamic cycles.

Some of the examples in the incorporated patents and patent applications contemplate an optimized skip fire approach in which the fired working chambers are fired under substantially optimal conditions (thermodynamic or otherwise). For example, the mass air charge introduced to the working chambers for each of the cylinder firings may be set at the mass air charge that provides substantially the highest thermodynamic efficiency at the current operating state of the engine (e.g., engine speed, environmental conditions, etc.). The described control approach works very well when used in conjunction with this type of optimized skip fire engine operation. However, that is by no means a requirement. Rather, the described control approach works very well regardless of the conditions that the working chambers are fired under.

As explained in some of the referenced patents and patent applications, the described firing control unit may be implemented within an engine control unit, as a separate firing control co-processor or in any other suitable manner. In many applications it will be desirable to provide skip fire control as an additional operational mode to conventional (i.e., all cylinder firing) engine operation. This allows the engine to be operated in a conventional mode when conditions are not well suited for skip fire operation. For example, conventional operation may be preferable in certain engine states such as engine startup, engine idle, low engine speeds, etc.

The described skip fire control can readily be used with a variety of other fuel economy and/or performance enhancement techniques—including lean burning techniques, fuel injection profiling techniques, turbocharging, supercharging, etc.

Most conventional variable displacement piston engines are arranged to deactivate unused cylinders by keeping the valves closed throughout the entire working cycle in an attempt to minimize the negative effects of pumping air through unused cylinders. The described embodiments work well in engines that have the ability to deactivate or shutting down skipped cylinders in a similar manner. Although this approach works well, the piston still reciprocates within the cylinder. The reciprocation of the piston within the cylinder introduces frictional losses and in practice some of the compressed gases within the cylinder will typically escape past the piston ring, thereby introducing some pumping losses as well. Frictional losses due to piston reciprocation are relatively high in piston engines and therefore, significant further improvements in overall fuel efficiency can theoretically be had by disengaging the pistons during skipped working cycles. In view of the foregoing, it should be apparent that the present embodiments should be considered illustrative and not restrictive and the invention is not to be limited to the details given herein, but may be modified within the scope of the appended claims.

What is claimed is:

1. A skip fire engine controller for a spark ignition engine having a throttle and a camshaft having a plurality of cams, the skip fire controller comprising:

a lookup table embodied in a computer readable media, wherein each entry in the lookup table includes a firing fraction field that stores a firing fraction indicator indicative of a desired firing fraction associated with such entry, wherein the firing fraction indicator does not identify any specific cylinders to fire;

a firing fraction determining unit arranged to determine a firing fraction suitable for delivering a requested engine output, wherein the firing fraction determining unit utilizes the lookup table to determine a desired firing fraction, wherein the firing fraction determining unit utilizes at least (i) the requested engine output, and (ii) a current engine speed as indices to select a desired firing fraction;

a firing controller arranged to direct firings in a skip fire manner that delivers the desired firing fraction; and a powertrain parameter adjusting module arranged to adjust at least one engine actuator that affects mass air charge (MAC) such that the engine delivers the requested engine output at the desired firing fraction, wherein the at least one engine actuator affects at least one of cam phase, cam lift and throttle position.

2. A skip fire engine controller as recited in claim 1 wherein an additional index for the lookup table includes transmission gear.

3. A skip fire engine controller as recited in claim 1 wherein an additional index for the lookup table includes at least one selected from the group consisting of:

manifold absolute pressure (MAP);
manifold air temperature;
a parameter indicative of mass air charge (MAC);
a parameter indicative of cam position
cylinder torque output;
engine torque output;
maximum permissible manifold pressure;
vehicle speed;
ambient temperature; and
barometric pressure.

4. A skip fire engine controller as recited in claim 1 wherein the lookup table is a multi-dimensional lookup table that includes a plurality of logically or physically separate lookup tables.

5. A skip fire engine controller as recited in claim 1 wherein the lookup table dictates operation in an all-cylinder operational mode in selected operational states.

6. A skip fire engine controller as recited in claim 5 wherein the selected operational states for all-cylinder operation include engine speeds below a first threshold and engine speeds above a second threshold.

7. A skip fire engine controller as recited in claim 1 wherein each entry in the lookup table further includes a MAC field arranged to store a MAC indicator indicative of a desired operational mass air charge.

8. A skip fire engine controller as recited in claim 7 wherein the MAC indicator is a relative value.

9. A skip fire engine controller as recited in claim 1 wherein each entry in the lookup table further includes a second field arranged to store a value indicative of a second desired operational parameter.

10. An engine controller that includes a skip fire engine controller as recited in claim 1 wherein the engine controller is arranged to sometimes operate the engine in an all cylinder firing mode in which the output of the engine is primarily modulated based on throttle position.

11. A skip fire controller for a spark ignition engine having a, the skip fire controller comprising:

a lookup table embodied in a computer readable media, the lookup table having a multiplicity of entries, each entry including a firing fraction field arranged to store an associated firing fraction indicator indicative of a desired firing fraction, wherein the firing fraction indicator does not identify any specific cylinders to fire, and wherein indices for the lookup table include, (i) a desired engine output, and (ii) a first operational power train parameter;

a firing controller arranged to direct firings in a skip fire manner that delivers a desired firing fraction selected using the lookup table; and a powertrain parameter adjusting module arranged to adjust at least one engine setting that affects at least one of mass air charge (MAC) and spark timing, such that the engine delivers a requested engine output at the desired firing fraction.

12. A skip fire controller as recited in claim 11 further comprising an additional index for the lookup table based on a second operational power train parameter that is different than the first operational power train parameter.

13. A skip fire controller as recited in claim 12 wherein the first and second operational power train parameters are selected from the group consisting of:

engine speed;
transmission gear;
manifold absolute pressure (MAP);
manifold air temperature;
mass air charge (MAC);
cylinder torque output;
cam position;
maximum permissible manifold pressure; and
vehicle speed.

14. A method of operating a spark ignition engine, the method comprising:

determining a desired engine output in terms of a desired torque fraction, wherein the desired torque fraction is indicative of the desired engine output relative to a reference maximum available engine output;

determining a desired operational firing fraction based on a lookup table that utilizes desired torque fraction as a first index and current engine speed as a second index wherein the lookup table has a multiplicity of entries, each entry including a firing fraction field arranged to store an associated firing fraction indicator indicative of a desired firing fraction, and wherein the firing fraction indicator does not identify any specific cylinders to fire; and determining a desired cylinder mass air charge (MAC) based at least in part on the determined desired operational firing fraction;

directing one or more engine actuators to operate in a manner that delivers the desired mass air charge; and directing skip fire operation of the engine at the desired operational firing fraction in a manner that delivers the desired engine output; and wherein operation at the desired cylinder mass air charge and the desired operational firing fraction causes the engine to deliver the desired engine output.

15. A skip fire engine controller arranged to determine which cylinder working cycles of a spark ignition engine to fuel and fire, and which cylinder working cycles to skip, the skip fire engine controller comprising:

a firing fraction determining unit arranged to dynamically determine a desired firing fraction based on a multi-dimensional lookup table, wherein indices for the multi-dimensional lookup table include i) a desired engine output;
ii) a current engine speed; and
iii) a current transmission gear; and a firing controller arranged to direct firings in a skip fire manner that delivers the desired firing fraction.

16. A skip fire engine controller as recited in claim 15 wherein the current engine speed index is arranged in selected ranges of engine speed.

17. A skip fire engine controller as recited in claim 15 wherein the determination of the desired firing fraction is further based on a current maximum manifold pressure that is desirable for use.

18. An engine control unit that includes a skip fire engine controller as recited in claim 15, the engine controller unit further being arranged to sometimes operate the engine in an all cylinder firing mode in which the output of the engine is primarily modulated based on throttle position.

19. A skip fire engine controller as recited in claim 9 wherein the second field stores a value indicative of one selected from the group consisting of:

throttle position;
cam position; and
MAP setting.

20. A method of controlling skip fire operation of an engine comprising:

determining a desired operational firing fraction by accessing a multi-dimensional lookup table having a multiplicity of entries, each entry including a firing fraction field arranged to store an associated firing fraction indicator indicative of a desired firing fraction, the multi-dimensional lookup table having a plurality of indices, each of which is used in the determination of desired operational firing fraction, wherein the indices for the multi-dimensional lookup table include:

(i) a desired engine output;
(ii) engine speed; and
(ii) a first operational power train parameter that is different than the engine speed; and determining a desired cylinder mass air charge (MAC) based at least in part on the determined desired operational firing fraction;

directing one or more engine actuators to operate in a manner that delivers the desired mass air charge; and directing skip fire operation of the engine at the desired operational firing fraction in a manner that delivers the desired engine output; and wherein operation at the desired mass air charge and the desired operational firing fraction causes the engine to deliver the desired engine output.

21. A method as recited in claim 20 wherein the first operational power train parameter is selected from the group consisting of:

transmission gear;
manifold absolute pressure (MAP);
manifold air temperature;
a parameter indicative of mass air charge (MAC);
a parameter indicative of cam position
cylinder torque output;
engine torque output;
maximum permissible manifold pressure;
vehicle speed;
ambient temperature; and
barometric pressure.

22. A skip fire engine controller as recited in claim 15 wherein each entry in the lookup table includes:

a firing fraction field arranged to store a firing fraction indicator indicative of a desired operational firing fraction; and a MAC field arranged to store a MAC indicator indicative of a desired operational mass air charge.

23. A skip fire engine controller as recited in claim 11 wherein the desired engine output index is represented in the form of a desired operational torque fraction indicative of the desired engine output relative to a reference maximum available engine output.

24. A skip fire engine controller as recited in claim 15 wherein the desired engine output index is represented in the form of a desired operational torque fraction indicative of the desired engine output relative to a reference maximum available engine output.

25. A method as recited in claim 14 wherein the one or more engine actuators affect at least one of throttle position, cam phase and cam lift.

26. A method as recited in claim 14 further comprising determining a desired spark timing to be used in conjunction with the desired mass air charge and the desired operational firing fraction to cause the engine to deliver the desired engine output.

* * * * *